United States Patent [19]

Satoh

[11] 4,354,281

[45] Oct. 19, 1982

[54] STRUCTURAL MEMBER FOR SLEEPING BAG

[75] Inventor: Tomoyoshi Satoh, Tokyo, Japan

[73] Assignee: Nihon Yohhin Kabushiki Kaisha, Tokyo, Japan

[21] Appl. No.: 166,686

[22] Filed: Jul. 1, 1980

[30] Foreign Application Priority Data

Jul. 4, 1979 [JP] Japan ..... 54/91222[U]
Oct. 31, 1979 [JP] Japan ..... 54/150085[U]

[51] Int. Cl.[3] ..... A41D 1/00; A41D 3/00; A47G 9/08

[52] U.S. Cl. ..... 2/69.5; 2/97; 5/413

[58] Field of Search ..... 2/69.5, 97, 93; 5/413, 5/448

[56] References Cited

U.S. PATENT DOCUMENTS

| | | | |
|---|---|---|---|
| 2,064,458 | 12/1936 | Bulpit et al. | 5/413 |
| 2,179,424 | 11/1939 | Phillips et al. | 5/413 X |
| 2,464,380 | 3/1949 | Daiber | 2/97 X |
| 2,540,331 | 2/1951 | Hlavaty | 5/413 X |
| 2,831,198 | 4/1958 | Datlof | 2/97 X |
| 3,116,489 | 1/1964 | Weiss | 2/97 |
| 3,169,298 | 2/1965 | Tachibana | 2/97 X |
| 3,541,620 | 11/1970 | Chapuis | 5/413 |
| 3,706,102 | 12/1972 | Grenier | 2/97 X |

*Primary Examiner*—H. Hampton Hunter
*Attorney, Agent, or Firm*—Berman, Aisenberg & Platt

[57] ABSTRACT

A structural component for forming sleeping bags or insulated items of wearing apparel is formed of an outer layer of waterproof or the like material and a laterally spaced inner lining material. Attached to the inner surface of the outer material is a layer of heat insulating material such as cotton, the upper surface of which is laterally spaced from the inner surface of the lining material. Extending transversely between the upper surface of the cotton material and the inner surface of the lining material are a plurality of spaced partition sheets forming tubular cavities therebetween. These cavities are filled with feathers and sealed at their outer ends.

10 Claims, 9 Drawing Figures

STRUCTURAL MEMBER FOR SLEEPING BAG

BACKGROUND OF THE INVENTION

1. Field of the Invention

The present invention relates to an improvement in the structure and method of assembling a sleeping bag.

2. The Prior Art

A sleeping bag structure is known, wherein the outside material and the lining form a space therebetween to be filled with a large quantity of feathers. Certainly, such a feather-filled sleeping bag is advantageous in certain aspects such as its ideal heat insulating effect and portability. However, it also has serious disadvantages such as its high cost and the fact that the feathers tend to bunch up within the sleeping bag structure, often adversely affecting the heat insulating effect.

Feathers are generally high in their moisture absorption characteristics and thus have their volume reduced as they absorb moisture. Such tendency causes a mass of feathers to become further bunched up in the sleeping bag structure and even after dried and redistributed within the sleeping bag, feathers can never be restored to their initial uniform distribution within the sleeping bag structure. This also adversely affects the heat insulating effect.

It has also been known that, after the space between the outside material and the lining has been filled with a layer of feathers, the sleeping bag may be subjected to a quilting operation performed through the outside material, the feather layer and the lining so as to clamp the feather layer against displacement thereof within the bag structure. However, such quilting disadvantageously prevents the feather layer from conforming to the configuration of a human body and deteriorates the heat insulating effect at least in the region of quilting. Thus, the most preferred characteristics of the high cost feather filler material cannot be adequately enjoyed.

Attempts have been made to solve the above-described problems. In one proposed solution, the structure of a sleeping bag is formed so that a layer of synthetic fiber or cotton and a thin layer of feathers are formed between the outside material and the lining and directly sewn together therewith. Such an improvement permits the ideal characteristics of feathers to be satisfactorily enjoyed by the user. The layer of feathers can be held to some degree against being bunched up against the layer of synthetic fibre cotton during use of the sleeping bag and the sleeping bag can be provided at a relatively low cost. However, even in this improved structure, the layer of feathers still bunches up to some extent and the problem of heat insulation remains unsolved.

In another proposed solution, the sleeping bag structure comprises an outside material, a lining and partition sheets interposed between the outside material and the lining in such a manner that the individual partition sheets are sewn along their upper and lower edges to the outside material and the lining material, respectively, to form a plurality of tubular spaces defined by the outside material, the lining and an associated pair of partition sheets, to be filled with respective portions of a feather layer together with respective portions of another heat insulating layer. In this prior art structure, however, it has been extremely difficult to fill the tubular spaces with the feather layer together with the other heat insulating layer. Consequently, the assembly of such sleeping bags has been extremely time consuming and cumbersome.

OBJECTS AND SUMMARY OF THE PRESENT INVENTION

An object of the present invention is to provide a sleeping bag structure comprising an outside material, a lining and a relatively small quantity of feathers inserted in a space defined between said outside material and the lining in such a manner that the feathers are prevented from becoming bunched up, thus avoiding heat loss, while maintaining the preferred characteristics peculiar to feathers, such as their excellent heat insulating effect, light weight and portability and at the same time retaining 100 percent of their inherent restorative capability in spite of being placed over a layer of different material; thus enabling an ideal sleeping bag, incorporating such structure, to be assembled at a relatively low cost.

Another object of the present invention is to provide a mass-producible sleeping bag basic structural component, which not only permits the feathers and the other heat insulating material to be easily and rapidly inserted into the component, but also enables a readily portable sleeping bag of extremely high heat insulating characteristics to be assembled therefrom, and in which the layer of feathers can slidably move within a limited range, when assembled into a sleeping bag with the layer of feathers being disposed along the inner side of the sleeping bag, thereby conforming to and completely covering the user's body with a resulting improved heat insulating effect.

Still another object of the present invention is to provide structural elements for a sleeping bag which can be smoothly sewn together so as to clamp the non-feather heat insulating layer rapidly and reliably.

According to the present invention, these objects are achieved by providing a sleeping bag structure comprising an outside material, a lining material, a heat insulating layer interposed within an internal space defined between the outside material and the lining material and closely adjacent the inner side of the outside material so as to form a space between the inner side of the heat insulating layer and the lining material, and partition sheets adapted to divide the last mentioned space into a plurality of compartments to be filled with feathers.

Another embodiment of the present invention comprises an outside sheet, an intermediate sheet of flexible and slippery material, a heat insulating layer of natural cotton, synthetic fiber or the like interposed between the outside sheet and the intermediate sheet, a lining sheet and a plurality of partition sheets arranged so that each of the partition sheets is fixed along one edge by a sewing thread running through said edge, the intermediate sheet and the outside sheet for clamping the cotton layer to said intermediate sheet while each of said partition sheets is fixed along the other edge by sewing, adhesion or other means to the lining sheet to form a tubular space defined by the intermediate sheet, the lining sheet and an associated pair of partition sheets, which is adapted to be filled with feathers and then to be sealed.

Other features and advantages of the present invention will be apparent from the following description with reference to the several embodiments shown in the accompanying drawings.

DETAILED DESCRIPTION OF THE PREFERRED EMBODIMENTS

Figure 1:
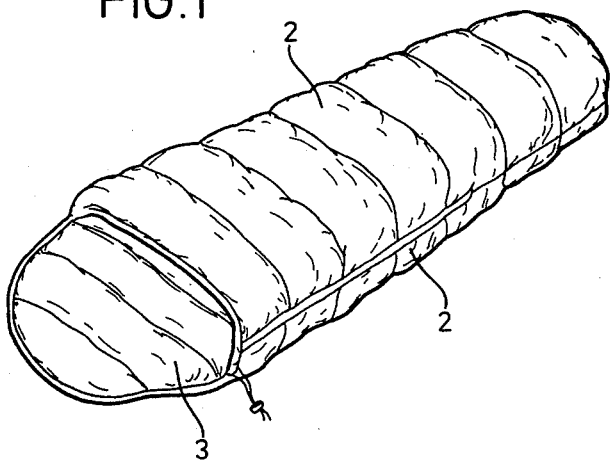
FIGS. 1 and 2 are perspective views of a sleeping bag assembled from structural components according to the present invention, in a complete condition and an incomplete condition, respectively.
Figure 2:
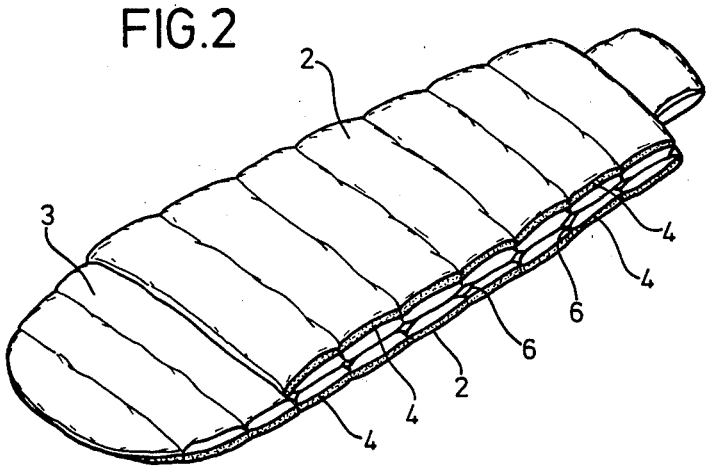
Figure 3:
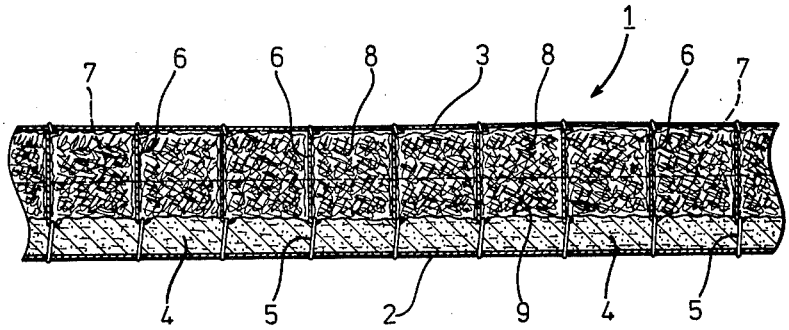
FIG. 3 is a longitudinal section of a first embodiment of the present invention.
Figure 4:
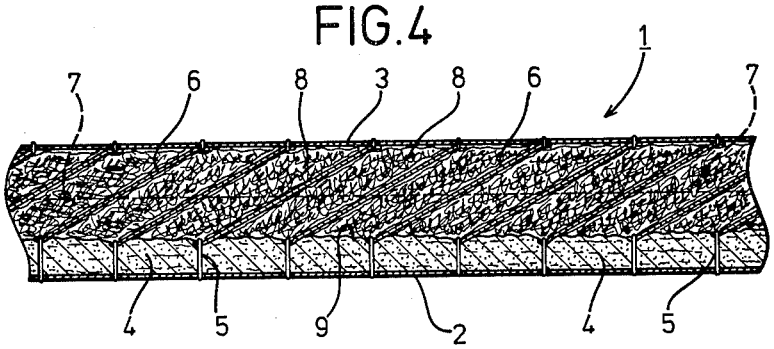
FIG. 4 is a section similar to FIG. 3 showing a second embodiment of the present invention.
Figure 5:
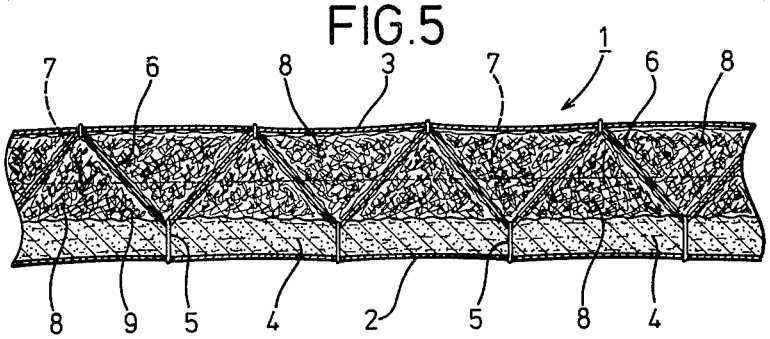
FIG. 5 is a section similar to FIG. 3 showing a third embodiment of the present invention.

Referring now to the drawings wherein like reference numerals designate like parts throughout the several views thereof, FIG. 1 illustrates an example of a sleeping bag consisting of structural members formed according to the present invention and FIG. 2 illustrates the same sleeping bag prior to hemming, along its lowermost edge. The basic structural component of the sleeping bag, generally designated by reference numeral 1, is shown in more detail in the embodiments of FIGS. 3 to 5. Interposed between the outside material 2 and lining material 3 is a layer 4 of heat insulating material such as natural or synthetic cotton or nonwoven cloth, immediately adjacent the inner side of the outside material 2 or the lining material 3. Partition sheets 6 of cloth or the like are longitudinally disposed on the inner side, as shown, of the heat insulating layer 4, one end of each partition sheet 6 being sewn to the heat insulating layer 4 and the other end of each partition sheet 6 being sewn to the lining material 3, so that there are formed spaces between the upper side 9 of the heat insulating layer 4 and the lining material 3. FIG. 3 illustrates an embodiment in which the partition sheets are vertically disposed; FIG. 4 illustrates another embodiment in which the partition sheets are disposed on a slant and FIG. 5 illustrates still another embodiment in which the partition sheets are disposed in a zig-zag manner. It should be noted that, although the partition sheets 6 have been shown in FIGS. 3 to 5 as each being sewn along one edge on the lining material 3 and along the other edge on the heat insulating layer 4 with threads 5 running therethrough, said one edge may be sewn on the rear side of the lining material 3 while said other edge may be sewn on the heat insulating material 4 as well as on the outside material 2. In such a case, it is preferred that a layer of a gauzy material be fixed to the upper side of the heat insulating layer 4. Attachment of the partition sheets may also be effected by other means, such as adhesive bonding.

Reference numeral 7 designates openings through which a small quantity of feathers 8 is introduced into respective compartments defined by each pair of adjacent partition sheets 6,6. Then, the respective openings 7 are sealed by sewing, adhesion or other means. The structural members thus formed may be assembled into a sleeping bag, for example, as illustrated in FIG. 1.

When the structural members are assembled into the sleeping bag, respective layers of feathers do not move beyond the associated partition sheets and these layers as a whole do not bunch up in the sleeping bag, since an extremely small quantity of feathers suffices to fill each compartment in view of the presence of the associated heat insulating layer 4. The layers of feathers 8 are accommodated within the respective compartments defined at their upper part by the outside material 2 or the lining material 3, laterally by the partition sheets 6,6 and at their lower part by the heat insulating layer 4.

As will be understood from the foregoing description, the present invention provides structural components for a sleeping bag, which can provide an ideal sleeping bag at low cost. More specifically, the small quantity of feathers filling the space between the outside material and the lining material is substantially prevented from being bunched up. Moreover, when the structural components are assembled into a sleeping bag, no loss of the heat insulating effect results from any bunching up of the feather layer. Thus, the layer of feathers incorporated therein can be advantageously put to use as to such characteristics as heat insulation, lightness, portability, compactness and sleeping comfort. Furthermore, the space between the outside material and the lining material is divided into a plurality of compartments in accordance with the present invention so that the individual layers of feathers can be uniformly distributed within the respective compartments and contribute to a high degree of restoration of the sleeping bag.

Figure 6:
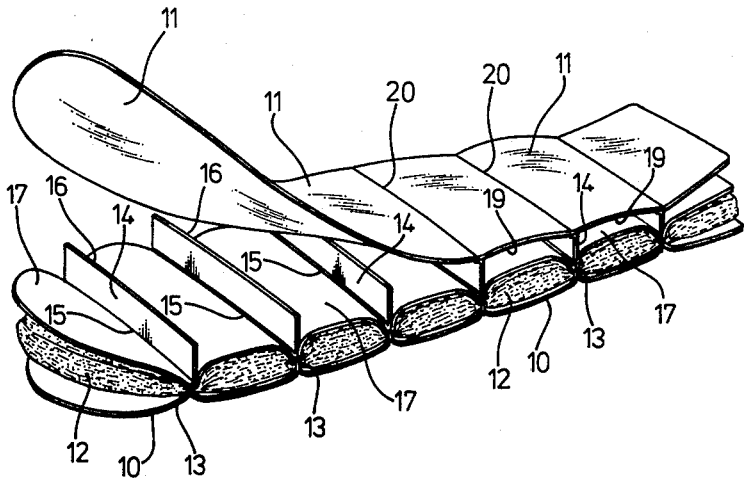
FIGS. 6 through 8 illustrate a fourth embodiment of the present invention in a perspective view, in a partial longitudinal section and in a partial enlarged longitudinal section; respectively.
Figure 7:
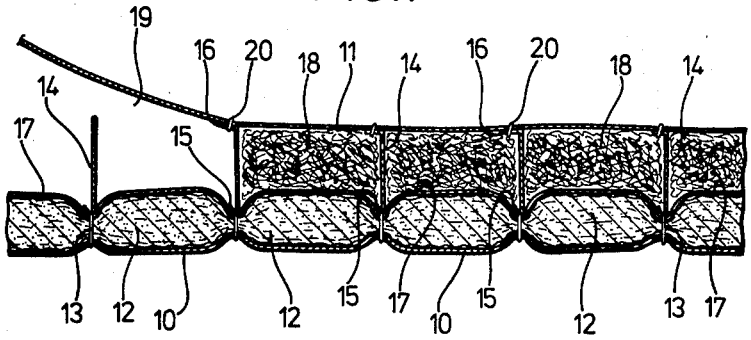
Figure 8:
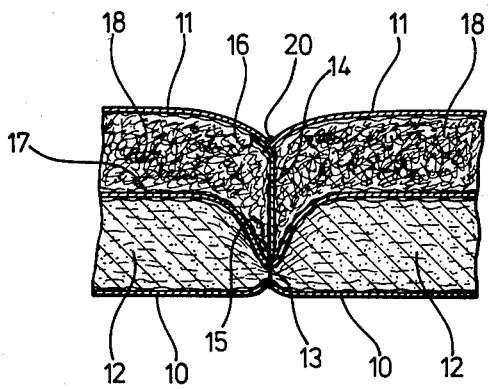

Referring to FIGS. 6 through 8 which illustrate another embodiment of the present invention, reference numeral 10 designates a sheet of material which is usually used for the outside of a sleeping bag, as for example, water-proof cloth of synthetic resin fibers or the like. A heat insulating layer 12 of synthetic cotton is placed thereon and an intermediate sheet 17 is placed upon the heat insulating layer. The intermediate sheet 17 is made of flexible and slippery material such as nylon or silk cloth and disposed on the upper side thereof are a plurality of partition sheets 14 transversely extending and being spaced longitudinally one from another. Sewing threads 13 extending through lower edges 15, the intermediate sheet 17, the layer 12 of synthetic fiber cotton and the outside sheet 10 serve to clamp layer 12 of synthetic fiber or cotton so that it is prevented from being disadvantageously moved or bunched up. Upper edges 16 of partition sheets 14 and lining sheet 11 are sewn or adhered together at 20 so that a plurality of tubular spaces 19 are defined by intermediate sheet 17, lining sheet 11 and partition sheets 14. One opening of each such space is sealed by sewing, adhesion or other means and a quantity of feathers 18 is inserted through an opposite opening into the space 19 to form the desired structural component for the sleeping bag. These members are assembled, with the respective lining sheets 11 inwardly facing, into a sleeping bag.

The construction concept described above can thus provide a structural component for a sleeping bag comprising two layers, i.e., a layer of feathers and a heat insulating layer other than feathers in an easy, rapid, economical and mass-producible manner employing an extremely simple technique in which the edges of the respective partition sheets can be sewn to the intermediate sheet and the heat insulating layer of synthetic fiber, cotton or the like can be fixed in place by sewing.

Figure 9:
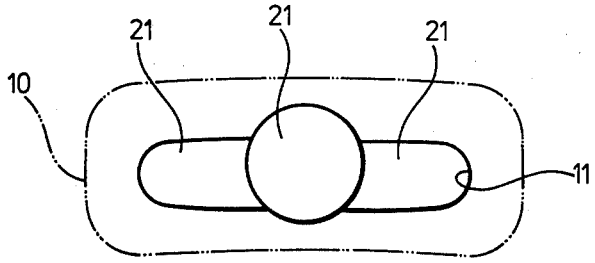
FIG. 9 is a schematic diagram illustrating a functional effect of the sleeping bag structural component according to the present invention.

According to the present invention, the intermediate sheet 17 of flexible and slippery material is employed, so that the needle of a sewing machine can smoothly run through the edge of each partition sheet, the intermediate sheet, the heat insulating layer of synthetic fiber, cotton or the like and the outside sheet, permitting the sewing of various components together and the anchoring of the heat insulating layer with a high degree of efficiency and reliability. It is also a feature of the present invention that the intermediate sheet of flexible and slippery material employed, as mentioned above, permits the feather layer inserted in the tubular space 19 defined by the intermediate sheet, the outside sheet and the associated partition sheets to freely, slidably move within the tubular space. When assembled into a sleeping bag, therefore, the layer of feathers properly moves within the respective tubular spaces 19 substantially in conformity with the configuration of a human body 21 (FIG. 9) so as to cover the latter closely and comfortably. Thus, the present invention provides a structural component for a sleeping bag having a heat insulating effect substantially higher than is conventionally achieved.

It should be understood that the structural component according to the present invention may be used to assemble items of clothing similar to sleeping bags and it is intended that such use for the structural component is included within the scope of the present invention.

I claim:

1. A structural component for a garment or sleeping bag comprising:

(a) a first layer of material;

(b) a second layer of material laterally spaced from said first layer;

(c) a layer of a first heat insulating material disposed between said first and second layers and having one surface, substantially adjacent the inner surface of said first layer and another surface laterally spaced from the inner surface of said second layer;

(d) a plurality of partition sheets extending between said another surface of said heat insulating layer and the inner surface of said second layer and terminating at said another surface, so as to form a plurality of transversely extending compartments between said another surface of said heat insulating layer and the inner surface of said second layer; and (e) said compartments being filled with a second heat insulating material.

2. The structural component set forth in claim 1 wherein said second heat insulating material comprises feathers.

3. A structural component as set forth in claim 1 or claim 2 wherein said partition sheets are affixed by sewing to either said first or second layers.

4. The structural component set forth in claim 1 or claim 2 further comprising a sheet of gauze-like material affixed to said another surface of said heat insulating layer, said partition sheets being affixed along one edge thereof to said gauze-like material.

5. A structural component as set forth in claim 1 or claim 2 wherein said partition sheets are disposed substantially at right angles with respect to said second layer of material.

6. A structural component as set forth in claim 1 or claim 2 wherein said partition sheets are disposed at an oblique angle with respect to said second layer of material.

7. A structural component as set forth in claim 1 or claim 2 wherein said partition sheets are disposed in a zig-zag fashion with respect to said second layer of material.

8. A structural component as set forth in claim 1 or claim 2 further including an intermediate sheet of flexible and slippery material disposed adjacent said another surface of said heat insulating layer, said partition sheets being affixed along one edge thereof to said intermediate sheet.

9. A structural component as set forth in claim 8 wherein said partition sheets are sewn by a thread running through said one edge, said intermediate sheet and said first layer so as to clamp said heat insulating layer to said intermediate sheet.

10. The structural component set forth in claim 1 or claim 2, wherein said first layer comprises an outer material and said second layer comprises a lining material.

* * * * *